US010241462B2

(12) United States Patent
Nakayama et al.

(10) Patent No.: US 10,241,462 B2
(45) Date of Patent: Mar. 26, 2019

(54) IMAGE FORMING APPARATUS

(71) Applicants: Masayoshi Nakayama, Ibaraki (JP); Takuma Higa, Kanagawa (JP); Masaki Sukesako, Kanagawa (JP); Masashi Tachi, Kanagawa (JP); Kazuaki Kamihara, Tokyo (JP); Yuichi Aizawa, Kanagawa (JP); Tomohide Takenaka, Kanagawa (JP); Kohei Matsumoto, Kanagawa (JP)

(72) Inventors: Masayoshi Nakayama, Ibaraki (JP); Takuma Higa, Kanagawa (JP); Masaki Sukesako, Kanagawa (JP); Masashi Tachi, Kanagawa (JP); Kazuaki Kamihara, Tokyo (JP); Yuichi Aizawa, Kanagawa (JP); Tomohide Takenaka, Kanagawa (JP); Kohei Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 24 days.

(21) Appl. No.: 15/714,610

(22) Filed: Sep. 25, 2017

(65) Prior Publication Data

US 2018/0143581 A1 May 24, 2018

(30) Foreign Application Priority Data

Nov. 21, 2016 (JP) ..... 2016-226156

(51) Int. Cl.
*G03G 15/00* (2006.01)
*G03G 21/00* (2006.01)
(Continued)

(52) U.S. Cl.
CPC ..... *G03G 21/0094* (2013.01); *G03G 15/0126* (2013.01); *G03G 15/0907* (2013.01)

(58) Field of Classification Search
CPC ..... G03G 21/0011; G03G 21/0094; G03G 15/0126; G03G 15/0907
See application file for complete search history.

(56) References Cited

U.S. PATENT DOCUMENTS

2006/0029436 A1* 2/2006 Toyoda ..... G03G 9/0827 399/279
2009/0028618 A1 1/2009 Kabata et al.
(Continued)

FOREIGN PATENT DOCUMENTS

JP 2002-123072 4/2002
JP 2005-018047 1/2005
(Continued)

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

An electrophotographic image forming apparatus includes a latent image bearer to rotate and bear a latent image, a charging device to charge the a latent image bearer, a developing device to develop the latent image with developer including toner and use a developing voltage including an AC component, and a lubricant applicator to apply lubricant onto a surface of the latent image bearer. An amount of the lubricant applied by the lubricant applicator onto the latent image bearer per centimeter in an axial direction of the latent image bearer is equal to or greater than 0.845 mg for a running distance of 1.0 kilometer of the latent image bearer, and a difference between a largest value and a smallest value of the developing voltage is in a range of 200 V to 400 V.

7 Claims, 8 Drawing Sheets

(51) Int. Cl.
*G03G 15/01* (2006.01)
*G03G 15/09* (2006.01)

(56) References Cited

U.S. PATENT DOCUMENTS

| | | | | |
|---|---|---|---|---|
| 2011/0026992 | A1* | 2/2011 | Shintani | G03G 21/0005 399/346 |
| 2011/0085824 | A1* | 4/2011 | Hatakeyama | G03G 15/751 399/159 |
| 2016/0026109 | A1 | 1/2016 | Nakayama et al. | |
| 2016/0291507 | A1 | 10/2016 | Nakayama et al. | |

FOREIGN PATENT DOCUMENTS

| | | |
|---|---|---|
| JP | 2009-025680 | 2/2009 |
| JP | 2009-109948 | 5/2009 |
| JP | 2014-115384 | 6/2014 |
| JP | 2016-011981 | 1/2016 |

* cited by examiner

IMAGE FORMING APPARATUS

CROSS-REFERENCE TO RELATED APPLICATIONS

This patent application is based on and claims priority pursuant to 35 U.S.C. § 119(a) to Japanese Patent Application No. 2016-226156, filed on Nov. 21, 2016, in the Japan Patent Office, the entire disclosure of which is hereby incorporated by reference herein.

BACKGROUND

Technical Field

This disclosure relates to an image forming apparatus, such as a copier, a printer, a facsimile machine, or a multifunction peripheral (MFP) having at least two of copying, printing, facsimile transmission, plotting, and scanning capabilities.

Description of the Related Art

There are electrophotographic image forming apparatuses that include a lubricant applicator to lubricate the surface of a latent image bearer and employs a developing voltage including an alternating-current (AC) component. Compared with a direct-current (DC) developing method in which the developing voltage consists of a DC component, an AC developing method using the developing voltage including the AC component is advantageous in ameliorating uneven image density caused by fluctuations of a developing gap.

SUMMARY

According to an embodiment of this disclosure, an electrophotographic image forming apparatus includes a latent image bearer to rotate and bear a latent image, a charging device to charge the a latent image bearer, a developing device to develop the latent image with developer including toner and use a developing voltage including an AC component, and a lubricant applicator to apply lubricant onto a surface of the latent image bearer. In the image forming apparatus, an amount of the lubricant applied by the lubricant applicator onto the latent image bearer per centimeter in an axial direction of the latent image bearer is equal to or greater than 0.845 mg for a running distance of 1.0 kilometer of the latent image bearer. Additionally, a difference between a largest value and a smallest value of the developing voltage is in a range of 200 V to 400 V.

In another embodiment, an image forming apparatus includes a plurality of toner image forming devices each of which including a latent image bearer to bear a latent image, a developing device to develop the latent image with developer including toner, and a lubricant applicator to apply lubricant onto a surface of the latent image bearer. The plurality of toner image forming devices includes a black image forming device to use black toner and a color image forming device to use color toner other than the black toner. The color image forming device uses a developing voltage including an AC component. By contrast, the black image forming device uses a developing bias without an AC component. An amount of the lubricant applied by the lubricant applicator onto the latent image bearer per centimeter in an axial direction of the latent image bearer is equal to or greater than 0.845 mg for a running distance of 1.0 kilometer of the latent image bearer. Additionally, a difference between a largest value and a smallest value of the developing voltage including the AC component is in a range of 200 V to 400 V.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
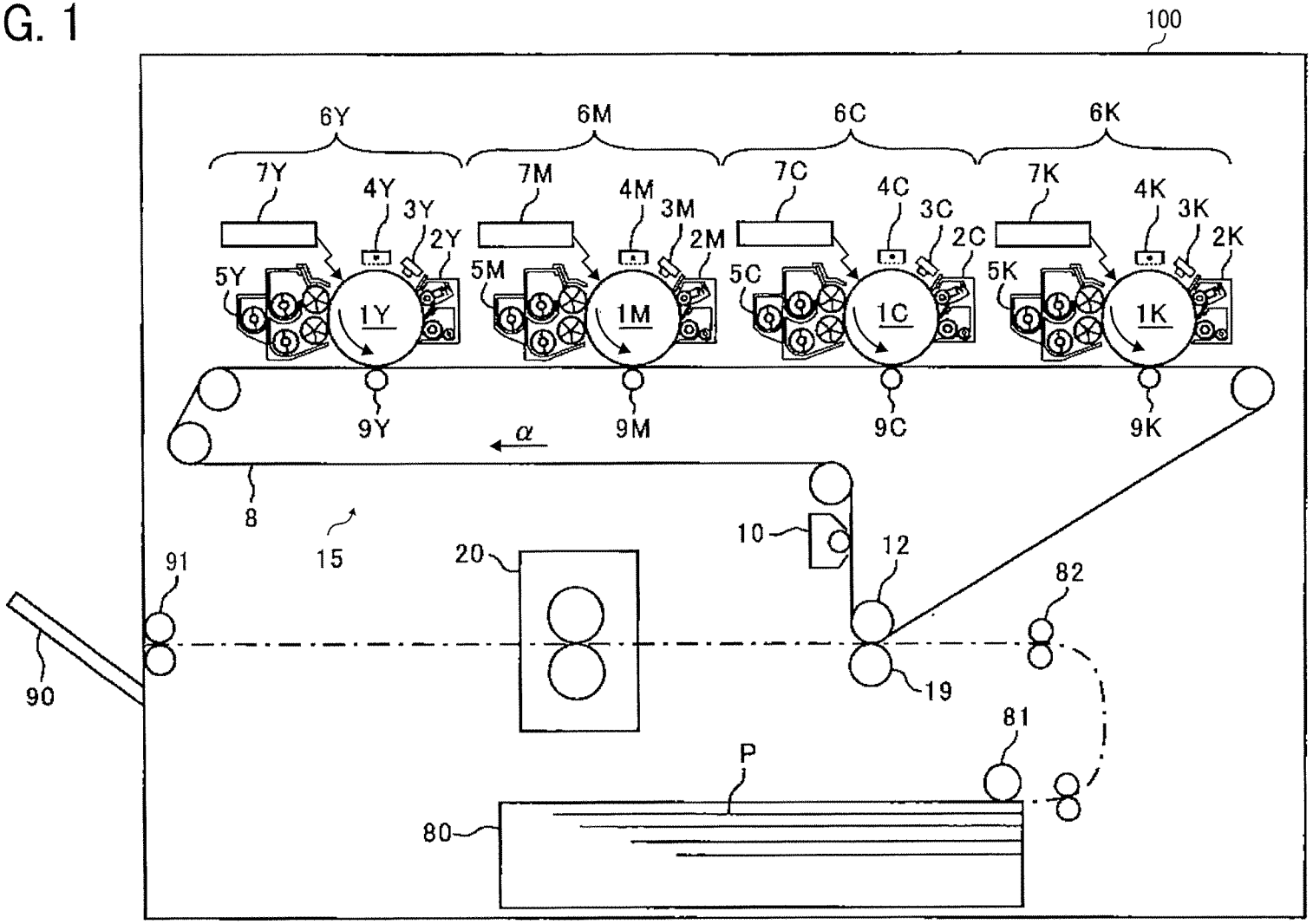
FIG. 1 is a schematic view of a printer as an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

The suffixes Y, M, C, and K attached to each reference numeral indicate only that components indicated thereby are used for forming yellow, magenta, cyan, and black images, respectively.

FIG. 1 is a schematic view of an image forming apparatus 100, which is an electrophotographic printer, according to the present embodiment.

As illustrated in FIG. 1, the image forming apparatus 100 includes four image forming units 6 (6Y, 6M, 6C, and 6K) as toner image forming units, to form magenta, cyan, yellow, and black toner images, respectively. The four image forming units 6 (Y, M, C, and K) are similar in configuration except that the color of toner used therein is different, and reference characters Y, M, C, and K representing the toner colors may be omitted in the description below when color discrimination is not necessary.

In the image forming apparatus 100, an intermediate transfer unit 15 including an endless intermediate transfer belt 8 serving as an intermediate transferor or intermediate transfer medium is disposed below the four image forming units 6 in FIG. 1. The intermediate transfer unit 15, serving as a transfer device, endlessly rotates the intermediate transfer belt 8 stretched around multiple tension rollers. Below the intermediate transfer unit 15, a fixing device 20 is disposed, and a sheet feeding tray 80 to contain transfer sheets P (recording media) is disposed below the fixing device 20. Broken lines represent a conveyance passage through which the transfer sheet P is transported inside the image forming apparatus 100.

Each of the image forming units 6 includes a drum-shaped photoconductor 1 (1Y, 1M, 1C, or 1K) serving as a latent image bearer, a photoconductor cleaning device 2 (2Y, 2M, 2C, or 2K) including a lubricant applicator, a discharger 3 (3Y, 3M, 3C, or 3K), a charging device 4 (4Y, 4M, 4C, or 4K), a developing device 5 (5Y, 5M, 5C, or 5K), and an exposure device 7 (7Y, 7M, 7C, or 7K) serving as a latent image forming device. The charging device 4 uniformly charges the surface of the photoconductor 1 that is rotated counterclockwise in FIG. 1 by a driver. The uniformly charged surface of the photoconductor 1 is scanned for exposure with a laser beam emitted from the exposure device 7 (the latent image forming device), thereby forming an electrostatic latent image according to image data of the corresponding color, on the surface of the photoconductor 1. Then, the developing device 5 develops the electrostatic latent image on the photoconductor 1 with toner into a toner image. The respective toner images on the photoconductors 1 are sequentially transferred onto the intermediate transfer belt 8 (i.e., an intermediate transfer process).

After the intermediate transfer process, the photoconductor cleaning device 2 removes the toner remaining on the surface of the photoconductor 1 (i.e., a cleaning process). The discharger 3 eliminates electric charges remaining on the cleaned photoconductor 1. Thus, the surface of the photoconductor 1 is initialized in preparation for subsequent image formation.

The intermediate transfer unit 15 includes the intermediate transfer belt 8, four primary-transfer bias rollers 9 (9Y, 9M, 9C, and 9K), a belt cleaner 10, and a secondary-transfer backup roller 12. The intermediate transfer belt 8 endlessly rotates clockwise in FIG. 1 as indicated by arrow a. The four primary-transfer bias rollers 9 (Y, M, C, and K) press against the four photoconductors 1 (Y, M, C, and K), respectively, via the intermediate transfer belt 8, and contact portions where the intermediate transfer belt 8 is nipped therebetween are called "primary transfer nips". The four primary-transfer bias rollers 9 apply transfer biases (of positive polarity, for example) opposite in polarity to the toner to a back surface (inside the loop) of the intermediate transfer belt 8.

Except the primary-transfer bias rollers 9, the multiple rollers to support the intermediate transfer belt 8 are electrically grounded. As the intermediate transfer belt 8 rotates and passes the four primary transfer nips sequentially, the yellow, magenta, cyan, and black toner images are transferred from the photoconductors 1 (Y, M C, and K) and superimposed one on another on the intermediate transfer belt 8 (primary transfer process). Thus, a four-color superimposed toner image (hereinafter "four-color toner image") is formed on the intermediate transfer belt 8.

The secondary-transfer backup roller 12 and a secondary transfer roller 19 press against each other via the intermediate transfer belt 8, and the contact portion therebetween is hereinafter referred to as a secondary transfer nip. A sheet feeding roller 81 sends out the transfer sheets P contained in the sheet feeding tray 80 one by one, and a registration roller pair 82 transports the transfer sheet P to the secondary transfer nip timed to coincide with the toner image.

The four-color toner image on the intermediate transfer belt 8 is transferred onto the transfer sheet P in the secondary transfer nip (secondary transfer process). In the secondary transfer nip, the surfaces of the intermediate transfer belt 8 and the secondary transfer roller 19 move in the same direction, and the transfer sheet P is sandwiched therebetween and transported thereby. After the transfer sheet P is released from the secondary transfer nip, the four-color toner image is fixed on the transfer sheet P with heat and pressure while the transfer sheet P passes between rollers of the fixing device 20.

After exiting the fixing device 20, the transfer sheet P is discharged by an ejection roller pair 91 onto an output tray 90 located outside the housing of the image forming apparatus 100.

On the intermediate transfer belt 8 that has passed the secondary transfer nip, there remains toner that is not transferred (i.e., residual toner) onto the transfer sheet P, and the belt cleaner 10 removes the residual toner.

Figure 2:
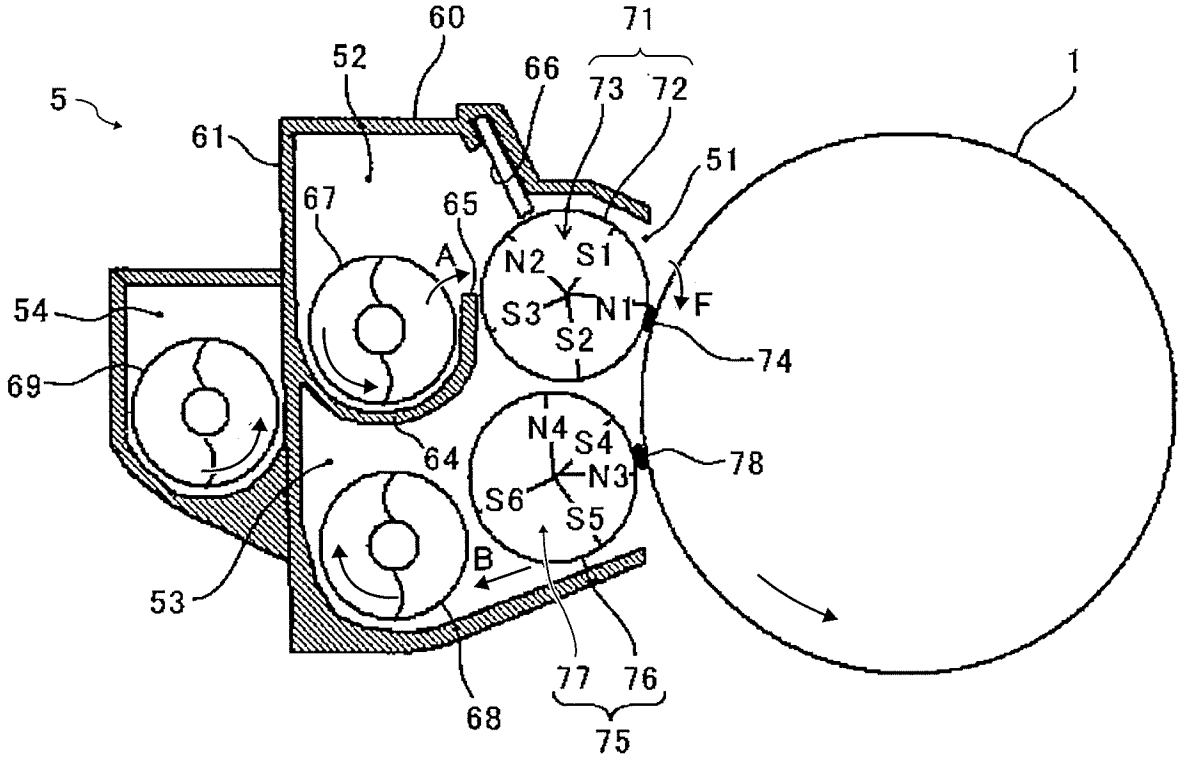
FIG. 2 is an enlarged end-on axial view of a developing device and a photoconductor of an image forming unit illustrated in FIG. 1.

FIG. 2 is an enlarged end-on axial view of the developing device 5 and the photoconductor 1 of the image forming unit 6.

The drum-shaped photoconductor 1 is disposed such that the axial direction thereof parallels a horizontal or substantially horizontal direction (hereinafter simply "horizontal direction"), which is perpendicular to the surface of the paper on which FIG. 2 is drawn. The developing device 5 includes a casing 60 (i.e., a developing device casing). The casing 60 defines a developing chamber 51 containing first developing roller 71 and a second developing roller 75, a developer supply chamber 52, a developer collecting chamber 53, and a developer returning chamber 54.

The first developing roller 71 inside the developing chamber 51 includes a first developing sleeve 72 to rotate clockwise in FIG. 2 and a first magnet roller 73 that is unitary and disposed inside the first developing sleeve 72. The second developing roller 75 is disposed below the first developing roller 71 inside the developing chamber 51 and includes a second developing sleeve 76 to rotate clockwise in FIG. 2 and a second magnet roller 77 that is unitary and disposed inside the second developing sleeve 76.

The developer supply chamber 52, the developer collecting chamber 53, and the developer returning chamber 54 are developer containing compartments to contain yellow, magenta, cyan, or black toner and carrier. In the three developer containing compartments, a supply screw 67, a collecting screw 68, and a returning screw 69 are rotatably disposed, respectively. The three screws circulate the developer inside the developing device 5 among the three developer containing compartments.

From the developer supply chamber 52, the developer is supplied to the first developing roller 71 disposed in an upper section of the developing chamber 51. From the second developing roller 75 disposed in a lower section of the developing chamber 51, the developer is collected into the developer collecting chamber 53. The developer collected in the developer collecting chamber 53 and toner supplied to the developer collecting chamber 53 are transported through the developer returning chamber 54 to the upstream end of the developer supply chamber 52 in the developer conveyance direction.

As the first developing sleeve 72 rotates, the developer supplied from the developer supply chamber 52 to the surface of the first developing sleeve 72 passes through a regulation position where a developer doctor 66 (a developer regulator) opposes the first developing sleeve 72. At the regulation position, the developer doctor 66 regulates the layer thickness of developer borne on the first developing sleeve 72. Subsequently, the developer is used in image developing in a first developing range 74 where the first developing sleeve 72 opposes the photoconductor 1, after which the developer reaches a position where the first developing sleeve 72 opposes the second developing sleeve 76 (i.e., sleeve opposing position). At the sleeve opposing position, the developer leaves the first developing sleeve 72 and is borne on the second developing sleeve 76. As the second developing sleeve 76 rotates, the developer borne on the second developing sleeve 76 is used in image developing in a second developing range 78 where the second developing sleeve 76 opposes the photoconductor 1. Downstream from the second developing range 78 in the direction of rotation of the second developing sleeve 76, the developer leaves the second developing sleeve 76 and is collected into the developer collecting chamber 53.

Figure 3:
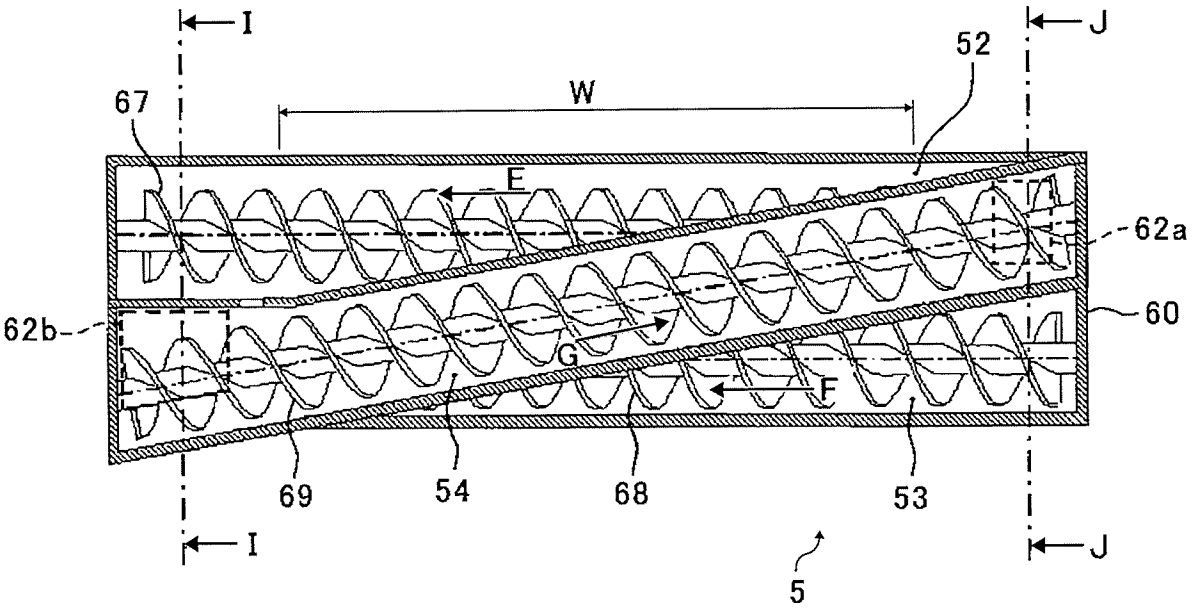
FIG. 3 illustrates relative positions of three compartments (a developer supply chamber, a developer collecting chamber, and a returning chamber) and three screws of the developing device illustrated in FIG. 2.

FIG. 3 illustrates relative positions of the above-mentioned three compartments and three screws when the developing device 5 is viewed form the left in FIG. 2. In the axial direction (lateral direction in FIG. 3) of the photoconductor 1, the developing chamber 51 is shorter than the three compartments and disposed in a range W illustrated in FIG. 3.

Figure 4:
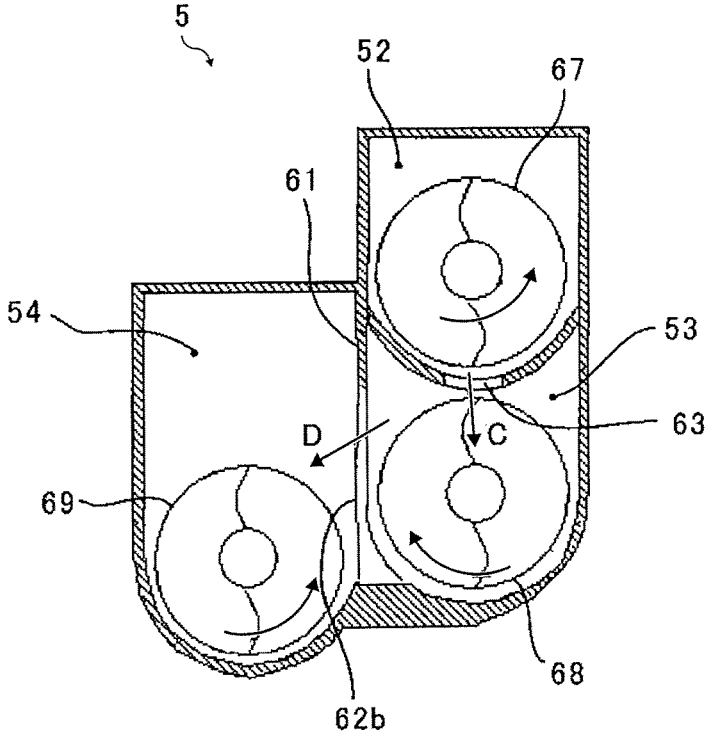
FIG. 4 is an end-on axial view of one end portion of the developing device illustrated in FIG. 3, in a longitudinal direction thereof.
Figure 5:
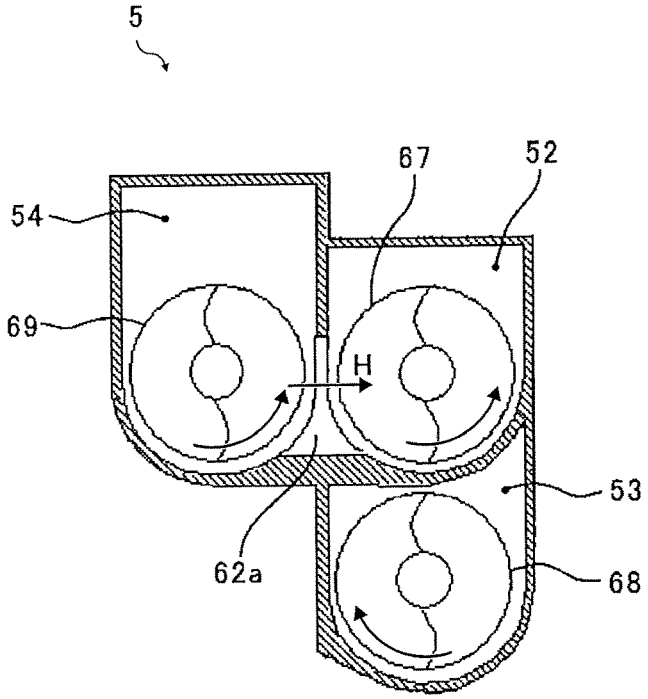
FIG. 5 is an end-on axial view of the opposite end portion of the developing device illustrated in FIG. 3, in the longitudinal direction thereof.

FIG. 4 is an end-on axial view along line I-I in FIG. 3 of one end portion (on the back side of the paper on which FIG. 2 is drawn) of the developing device 5 in the longitudinal direction thereof. FIG. 5 is an end-on axial view along line J-J in FIG. 3 of the other end portion (on the front side of the paper on which FIG. 2 is drawn) of the developing device 5 in the longitudinal direction thereof.

The developing chamber 51 contains the first and second developing rollers 71 and 75 to rotate and to develop the electrostatic latent image on the photoconductor 1 with toner. The second developing roller 75 is located below the first developing roller 71.

The axes of the first developing sleeve 72 and the second developing sleeve 76 are parallel to the axis of the photoconductor 1 that is horizontal. In the description below, the direction in which the axes of the two developing sleeves extend is simply referred to as "sleeve axial direction.

The supply screw 67 disposed in the developer supply chamber 52 stirs and conveys, by rotation, the developer contained in the developer supply chamber 52. Further, the supply screw 67 supplies the developer to the first developing sleeve 72. The collecting screw 68 disposed in the developer collecting chamber 53 stirs and conveys the developer collected from the second developing sleeve 76 and the toner supplied to the developer collecting chamber 53. The returning screw 69 disposed in the developer returning chamber 54 stirs and conveys the developer collected by the developer collecting chamber 53 and the supplied toner to the upstream end of the developer supply chamber 52 in the developer conveyance direction.

As illustrated in FIG. 2, the casing 60 has an opening on the side facing the photoconductor 1, and the two developing sleeves 72 and 76 in the developing chamber 51 are exposed from the opening, partly in the direction of circumference (arc-shaped direction). On the side of the developing chamber 51 opposite the photoconductor 1, the developer supply chamber 52 communicates with the developer collecting chamber 53 throughout in the range W in FIG. 3 in the sleeve axial direction.

As illustrated in FIGS. 2, 4, and 5, the developer supply chamber 52 is disposed directly above the developer collecting chamber 53.

The supply screw 67 is made of a nonmagnetic material such as resin, and the rotation shaft of the supply screw 67 is parallel to the sleeve axial direction. The supply screw 67 includes a rod-shaped rotation shaft and a spiral-shaped screw blade 34 projecting from the rotation shaft. The rotation shaft and the screw blade rotate together counterclockwise in FIG. 2, driven by a driver including a motor and a drive transmission system.

Similarly, the collecting screw 68 is made of a nonmagnetic material such as resin, and the rotation shaft thereof is parallel to the sleeve axial direction. Accordingly, the supply screw 67 and the collecting screw 68 are disposed with the axes thereof parallel to each other. The collecting screw 68 includes a rotation shaft and a spiral-shaped screw blade projecting from the surface of the rotation shaft. The rotation shaft and the screw blade rotate together clockwise in FIG. 2, driven by a driver including a motor and a drive transmission system.

In the lateral direction FIG. 2, the developer returning chamber 54 is adjacent to the developer supply chamber 52 and the developer collecting chamber 53 on the side opposite the developing chamber 51.

Differently from the developing chamber 51, the developer supply chamber 52, and the developer collecting chamber 53, the developer returning chamber 54 extends in not the horizontal direction but a direction oblique to the horizontal direction.

The returning screw 69 is made of a nonmagnetic material such as resin and includes a rod-shaped rotation shaft and a screw blade projecting from the rotation shaft. The rotation shaft of the returning screw 69 is disposed oblique to the sleeve axial direction and along the direction in which the developer returning chamber 54 extends. Driven by a driver such as a motor and a drive transmission system, the returning screw 69 rotates counterclockwise in FIG. 2.

Most of the developer returning chamber 54 in the longitudinal direction thereof is partitioned by a partition 61 from the developer supply chamber 52 and the developer collecting chamber 53, and portions of the developer returning chamber 54 communicates with the developer supply chamber 52 and the developer collecting chamber 53 through openings 62*a* and 62*b* secured in the partition 61.

In the developer supply chamber 52, as the supply screw 67 rotates, the developer held between the threads of the screw blade of the supply screw 67 is transported in the direction indicated by arrow E in FIG. 3, from the front side to the back side in the direction perpendicular to the surface of the paper on which FIG. 2 is drawn.

While being transported, the developer is sequentially supplied to the first developing sleeve 72 in the developing chamber 51 as indicated by arrow A illustrated in FIG. 2. The developer is then carried on the surface of the first developing sleeve 72 due to the magnetic force exerted by the magnet roller 73 inside the first developing sleeve 72.

By contrast, the developer that is not carried onto the surface of the first developing sleeve 72 is transported to the downstream end portion in the developer conveyance direction of the supply screw 67 (back side in the direction perpendicular to the surface of the paper on which FIG. 2 is drawn). As indicated by arrow C in FIG. 4, the developer falls from an opening 63 on a bottom wall of the developer supply chamber 52 toward the developer collecting chamber 53.

Referring to FIG. 2, as the first and second developing sleeves 72 and 76 rotate, the developer carried thereof pass through the first and second developing ranges 74 and 78, respectively, and contribute to developing of the electrostatic latent image on the photoconductor 1. After used in the developing, as the second developing sleeve 76 rotates, the developer carried thereon is transported to a communicating portion between the developing chamber 51 and the developer collecting chamber 53.

Then, separated from the surface of the second developing sleeve 76 by a repulsive magnetic field generated by a magnetic pole arrangement of the second magnet roller 77, the developer falls to the developer collecting chamber 53 as indicated by arrow B illustrated in FIG. 2.

In the developer collecting chamber 53, as the collecting screw 68 rotates, the developer held between the threads of the screw blade of the collecting screw 68 is transported from the front side to the back side in the direction perpendicular to the paper surface on which FIG. 2 is drawn, as indicated by arrow F in FIG. 3.

While the developer is thus transported, a toner supply device of the image forming apparatus 100 supplies toner to the developer collecting chamber 53. In addition, in the downstream end portion of the developer collecting chamber 53 in the developer conveyance direction therein, the developer collecting chamber 53 receives the developer falling from the developer supply chamber 52 through the opening 63.

In the downstream end portion (adjacent to the back end in the direction penetrating FIG. 2) in the developer conveyance direction by the collecting screw 68, the developer enters the developer returning chamber 54 through the opening 62*b* in the partition 61, as indicated by arrow D in FIG. 4. Then, the developer is received in the upstream end portion of the developer returning chamber 54 in the developer conveyance direction by the returning screw 69.

In the developer returning chamber 54, the developer is transported obliquely upward as indicated by arrow G in FIG. 3, by rotation of the returning screw 69 disposed obliquely upward from the upstream side to the downstream side in the developer conveyance direction. After conveyed obliquely upward to the downstream end portion in the developer conveyance direction by the returning screw 69, the developer is returned through the opening 62*a* in the partition 61 to the developer supply chamber 52, as indicated by arrow H in FIG. 5.

Then, the developer is received in the upstream end portion of the developer supply chamber 52 in the developer conveyance direction by the supply screw 67.

In the above-described image forming apparatus 100, the four photoconductors 1 (Y, M, C, and K) serve as the latent image bearers having surfaces to move endlessly by rotation and carry electrostatic latent images. The exposure devices 7 (Y, M, C, and K) serve as latent image forming devices to form the electrostatic latent images on the respective surfaces of the photoconductors 1 charged uniformly. Further, the developing devices 5 (Y, M, C, and K) develop the electrostatic latent images on the photoconductors 1 (Y, M, C, and K).

Next, descriptions are given below of relations between magnetic poles on the developing sleeves 72 and 76 and the movement of developer.

Initially, the magnetic poles of the first magnet roller 73 inside the first developing sleeve 72 are described.

As illustrated in FIG. 2, the first magnet roller 73 has five magnetic poles: two north poles (N1 and N2) and three south poles (S1, S2, and S3). Of the two north poles, a first developing pole N1 opposes, via the first developing sleeve 72, the photoconductor 1 in the first developing range 74, and a regulation pole N2 opposes, via the first developing sleeve 72, the end of the developer doctor 66 and exerts a magnetic force to attract the developer to the first developing sleeve 72 at the regulation position. One of the south poles is a post-regulation conveyance pole S1. After the developer passes the regulation position as the first developing sleeve 72 rotates, the developer is retained on the first developing sleeve 72 by the post-regulation conveyance pole S1 before entering the first developing range 74.

Another south pole, a developer scooping pole S3 serves as both of a pre-regulation pole disposed adjacent to and upstream from the regulation pole N2 in the direction of rotation of the first developing sleeve 72 and a scooping pole to scoop the developer around the supply screw 67 onto the surface of the first developing sleeve 72. Another south pole is a developer forwarding pole S2. After the developer passes through the first developing range 74 as the first developing sleeve 72 rotates, the developer is forwarded to a developer receiving pole N4 of the second developing roller 75.

Next, the magnetic poles of the second magnet roller 77 inside the second developing sleeve 76 are described.

As illustrated in FIG. 2, the second magnet roller 77 has five magnetic poles: two north poles and three south poles. One of the north poles is the developer receiving pole N4 to receive the developer from the developer forwarding pole S2 of the first developing roller 71 as described above. One of the south poles is a conveyance pole S4 to retain the developer on the surface of the second developing sleeve 76 before the developer enters the second developing range 78 as the second developing sleeve 76 rotates. Another north pole is a second developing pole N3 that opposes, via the second developing sleeve 76, the photoconductor 1 in the second developing range 78.

Another south pole is a retaining pole S5 to retain the developer on the surface of the second developing sleeve 76 before the developer enters a range opposing the collecting screw 68. Another south pole is a repulsive magnetic pole S6 identical in polarity (S-pole) to the adjacent retaining pole S5 upstream therefrom in the direction of rotation of the second developing sleeve 76. The repulsive magnetic pole S6 generates a repulsive magnetic field between the two magnetic poles. As the second developing sleeve 76 rotates, the developer is separated from the second developing sleeve 76 by the effect of the repulsive magnetic field generated by the retaining pole S5 and the repulsive magnetic pole S6 and is collected in the developer collecting chamber 53.

In FIG. 2, the reference characters of the magnetic poles of the first and second magnet rollers 73 and 77 are disposed at peak positions at which the respective magnetic forces exerted on the developing sleeve surfaces by the magnetic poles are greatest.

The casing 60 of the developing device 5 includes a receiving portion 64 to partition the developer supply chamber 52 in which the supply screw 67 is disposed from the developer collecting chamber 53 located below the developer supply chamber 52. The receiving portion 64 is made of a nonmagnetic material such as resin. At a position below the supply screw 67 in the direction of gravity, the receiving portion 64 receives the developer on a face thereof so that the supply screw 67 can stir and convey the developer.

Descriptions are given below of a supply position where the supply screw 67 supplies the developer to the first developing sleeve 72.

As illustrated in FIG. 2, the receiving portion 64 is shaped to conform to the outline of the screw blade of the supply screw 67 from the partition 61 toward the first developing sleeve 72, and an end of the receiving portion 64 near to the first developing sleeve 72 (hereinafter "sleeve-side end 65") is an upper end of the receiving portion 64. The sleeve-side end 65 opposes, of the entire surface of the first developing sleeve 72, a portion downstream from the developer scooping pole S3 (i.e., a peak position of scooping magnetic force) in the direction of rotation of the first developing sleeve 72. In the developer supply chamber 52, the developer is supplied at a position adjacent to the sleeve-side end 65 of the receiving portion 64 to the first developing sleeve 72.

As indicated by arrow A in FIG. 2, the first developing sleeve 72 starts scooping the developer thereonto as the developer reaches the side of the sleeve-side end 65 of the receiving portion 64.

In configurations, such as the image forming apparatus 100, that include a cleaner such as a cleaning blade to remove residual toner from the photoconductor 1, the surface layer of the photoconductor 1 may be abraded with the elapse of time due to mechanical stress as the cleaner rubs on the photoconductor 1. Such abrasion reduces the life of the photoconductor 1.

Additionally, inherent to improvement on image quality in recent years, the particle size of toner used in image formation is decreasing and circularity of toner is increasing. Accordingly, the toner can easily pass through the gap between the photoconductor and the cleaning blade. The toner escaping the cleaning blade can cause defective charging of the photoconductor and defective exposure in optical scanning, degrading imager quality.

The image forming apparatus 100 includes a lubricant applicator to apply zinc stearate as lubricant onto the surface of the photoconductor 1 (image bearer), as described later. The zinc stearate applied on the surface of the photoconductor 1 can reduce the friction between the photoconductor 1 and the photoconductor cleaner to suppress the wear of the photoconductor 1. Further, zinc stearate can reduce the adhesive force between the photoconductor 1 and the residual toner, thereby inhibiting the toner from escaping the photoconductor cleaner in the contact portion between the photoconductor cleaner and the photoconductor 1.

Figure 6:
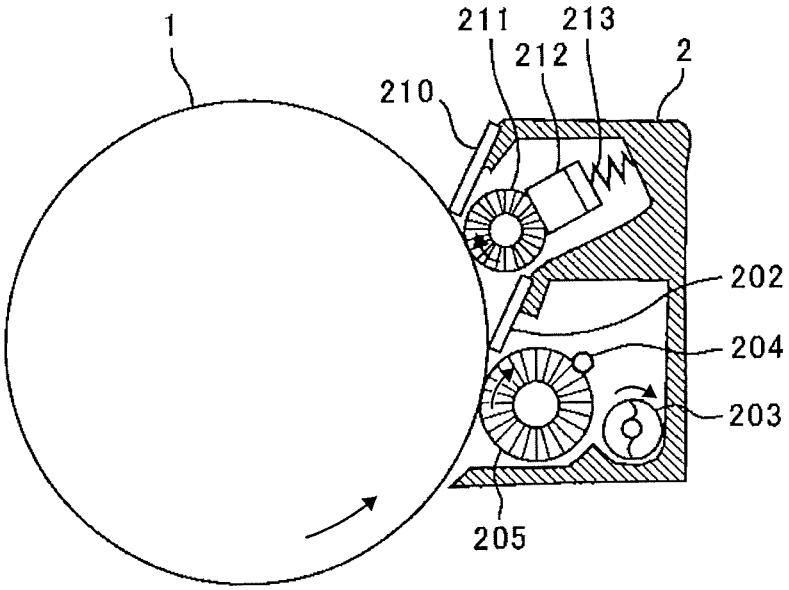
FIG. 6 is an enlarged end-on axial view of a photoconductor cleaning device and the photoconductor of the image forming unit illustrated in FIG. 1.

FIG. 6 is an enlarged end-on axial view of the photoconductor cleaning device 2 and the photoconductor 1 of the image forming unit 6.

The photoconductor cleaning device 2 includes a cleaning brush 205 (a rotatable brush), a cleaning blade 202, an application brush 211 serving as the lubricant applicator, and a leveling blade 210 to level off the lubricant, which are disposed in that order from the upstream side in the direction of rotation of the photoconductor 1.

The cleaning brush 205 is a brush roller that rotates clockwise in FIG. 6, driven by a driver. The cleaning blade 202 is a blade that is cantilevered by a casing of the photoconductor cleaning device 2, and a free end of the cleaning blade 202 contacts (abuts against) the surface of the photoconductor 1 in the direction counter to the rotation of the photoconductor 1.

In the photoconductor cleaning device 2, after the cleaning brush 205 rubs the residual toner on the photoconductor 1, the cleaning blade 202 scrapes off, with an edge thereof, the residual toner from the surface of the photoconductor 1. The removed toner falls on the cleaning brush 205 and is carried thereon. As the cleaning brush 205 rotates, a flicker bar 204 that contacts the cleaning brush 205 removes the toner from the cleaning brush 205. The removed toner falls on a collecting coil 203 and is discharged by the collecting coil 203 outside the photoconductor cleaning device 2. The toner thus discharged falls to a waste-toner bottle of the image forming apparatus 100.

The application brush 211 is disposed downstream from the cleaning blade 202 in the direction of rotation of the photoconductor 1. The application brush 211 includes a columnar rotation shaft and a plurality of bristles raised on the circumference of the rotation shaft and rotates clockwise in FIG. 6, driven by a driver. Against the application brush 211, a coil spring 213 presses a solid lubricant 212.

The leveling blade 210 is disposed downstream from the application brush 211 in the direction of rotation of the photoconductor 1. The leveling blade 210 is cantilevered by the casing of the photoconductor cleaning device 2, and a free end of the leveling blade 210 contacts (abuts against) the surface of the photoconductor 1 in the direction counter to the rotation of the photoconductor 1.

While rotating, the application brush 211 scrapes off powdered lubricant from the solid lubricant 212 and applies the powdered lubricant onto the surface of the photoconductor 1. Then, the leveling blade 210 levels off the lubricant applied to the surface of the photoconductor 1. Lubricating the photoconductor 1 can reduce the frictional resistance on the surface of the photoconductor 1 to improve cleaning performance and transfer performance and suppress filming.

Examples of the bristles used for the application brush 211 (the lubricant applicator) include insulative or conductive polyethylene terephthalate and acrylic fiber. Alternatively, instead of the application brush 211, the lubricant applicator may be a sponge roller.

Example materials of the solid lubricant 212 include a variety of fatty acid salts and zinc stearate. Alternatively, a main ingredient of the solid lubricant 212 can be a fatty acid metal salt including a fatty acid such as stearic acid, palmitate, myristic acid, oleate, and a metal such as zinc, aluminum, calcium, magnesium, iron, and lithium. Zinc stearate is particularly preferable.

The amount of the solid lubricant 212 applied per unit running distance of 1 km of the photoconductor 1 in unit area of 1 cm (predetermined unit area) in the axial direction of the photoconductor 1 is preferably equal to or greater than 0.845 mg. When the amount of lubricant applied is smaller than such a value, the cleaning blade 202 can curl in a hot environment or the cleaning blade 202 can make a noise. By contrast, the inventors empirically know curl or noise of the cleaning blade 202 is inhibited when the amount of lubricant applied is kept at such a value. As long as such effects are secured, the amount of lubricant applied is preferably smaller to reduce ablation of the solid lubricant 212. In practice, however, the applied lubricant may be scraped off in the charging, developing, transfer, and cleaning processes, or the applied amount may become uneven or decrease. Accordingly, a margin is left in the application amount of lubricant.

According to consideration of the inventors, 1.8 mg is sufficient as the application amount, but variations up to 3.6 mg are possible. Although the application amount setting is 14 mg depending on machine specification, such setting is because of the amount of lubricant lost in the charging process. It is conceivable that the amount is not very different from 3.6 mg in the developing range in which a streak or unevenness occurs. What is necessary is coating the photoconductor 1 with a given thickness of lubricant from the solid lubricant 212, and the applied amount does not depend on the type of lubricant.

The developing device 5 of the image forming apparatus 100 is a two-component developing device that develops the electrostatic latent image on the photoconductor 1 (the image bearer) with two-component developer including toner and carrier. In the developing device 5, portions of the first and second developing sleeves 72 and 76 of the developing rollers 71 and 75 oppose the photoconductor 1 to form the first and second developing ranges 74 and 78, respectively. The first and second magnet rollers 73 and 77 (magnetic field generators) respectively disposed inside the first and second developing sleeves 72 and 76 generate magnetic fields to cause the developer particles to stand on end, in the form of magnetic brushes, on the first and second developing sleeves 72 and 76, and the magnetic brushes contact or come close to the photoconductor 1 in the first and second developing ranges 74 and 78. Thus, the toner adheres to the electrostatic latent image on the surface of the photoconductor 1, developing the electrostatic latent image.

In the developing device 5, the toner borne on the developing sleeves 72 and 76 moves to the photoconductor 1 due to differences in surface potential between the photoconductor 1 and the first and second developing sleeves 72 and 76 to which developing voltage is applied. The methods of applying the developing voltage to the developing sleeves of such developing devices include a method using voltage including a DC component only (hereinafter referred to as "DC bias development") and a method using voltage including an AC component (hereinafter referred to as "AC bias development"). The developing device 5 according to the present embodiment employs AC bias development.

Figure 7:
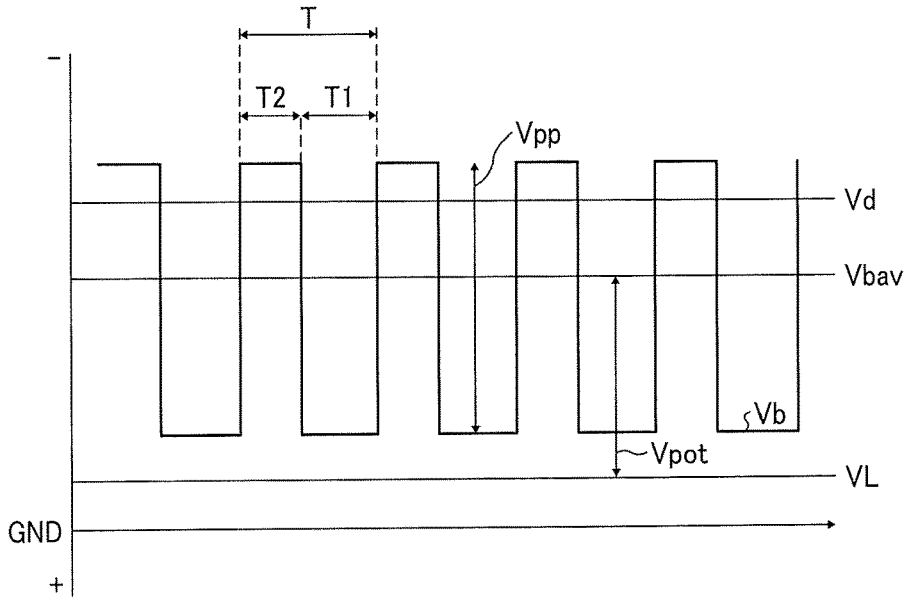
FIG. 7 is a graph of a waveform of a developing bias according to an embodiment.

FIG. 7 is a graph of a waveform of a developing bias Vb applied to the first and second developing sleeves 72 and 76 of the developing device 5 of the image forming apparatus 100 according to the present embodiment.

The developing bias Vb according to the present embodiment is a voltage including an AC component.

In FIG. 7, reference character "GND" represents ground voltage (earth voltage), which is 0 V. The voltage value increases on the negative (minus) side as the position rises in FIG. 7, and the voltage value increases on the positive side as the position descends in FIG. 7.

In FIG. 7, reference character "T" represents one cycle of the developing bias Vb in which the voltage changes cyclically due to an AC component. Reference character "T1" in FIG. 7 represents the duration of application of opposite polarity component during one cycle of the developing bias Vb. The opposite polarity component (in the positive polarity) is opposite in polarity to the normal charge polarity of toner (negative in the present embodiment) with reference to the average of the developing bias Vb (hereinafter "developing bias average Vbav"). Reference character "T2" in FIG. 7 represents the duration of application of normal polarity component during one cycle of the developing bias Vb. The normal polarity component is identical in polarity to the normal charge polarity of toner (negative in the present embodiment) with reference to the developing bias average Vbav.

The developing bias Vb according to the present embodiment is a voltage including an AC component having a frequency (1/T) of 5.0 kHz to 10 kHz. Additionally, the opposite polarity component (the positive polarity), which is opposite the normal charge polarity (negative) of toner relative to the developing bias average Vbav of the developing bias Vb, has a duty cycle (T1/T×100, hereinafter "opposite-polarity duty cycle") of 40% to 70%. A peak-to-peak voltage Vpp, which means the difference between the largest value and the smallest value of the developing bias Vb, is 200 V to 400 V.

In the present embodiment, the normal charge polarity of toner is negative (minus), and the surface potential of the developing sleeve (72 and 76) changes only in the negative polarity that is the normal charge polarity of toner, with reference to the ground voltage GND. Accordingly, the largest value of the developing bias Vb is closest to 0 V, and the smallest value of the developing bias Vb is farthest from 0 V.

By contrast, in a case where the surface potential changes also in the positive polarity (opposite the negative polarity) with reference to the ground voltage GND, the largest positive value is the largest value of the developing bias Vb.

In the present embodiment, as illustrated in FIG. 7, a smallest value of the developing bias Vb in the normal charge polarity (negative) of toner means the largest value of the developing bias Vb and is larger in the normal charge polarity of toner than an exposure potential VL. The exposure potential VL is the potential of the latent image (i.e., potential of exposed portion) of the photoconductor 1.

In the example illustrated in FIG. 7, the developing bias average Vbav is −350 V, and a charged potential Vd (unexposed area potential) is −450 V and greater by 100 V than the developing bias average Vbav in the negative polarity. The exposure potential VL is −100 V.

In the example illustrated in FIG. 7, the difference between the developing bias average Vbav and the exposure potential VL (hereinafter "developing potential Vpot") is 250 V.

Figure 8:
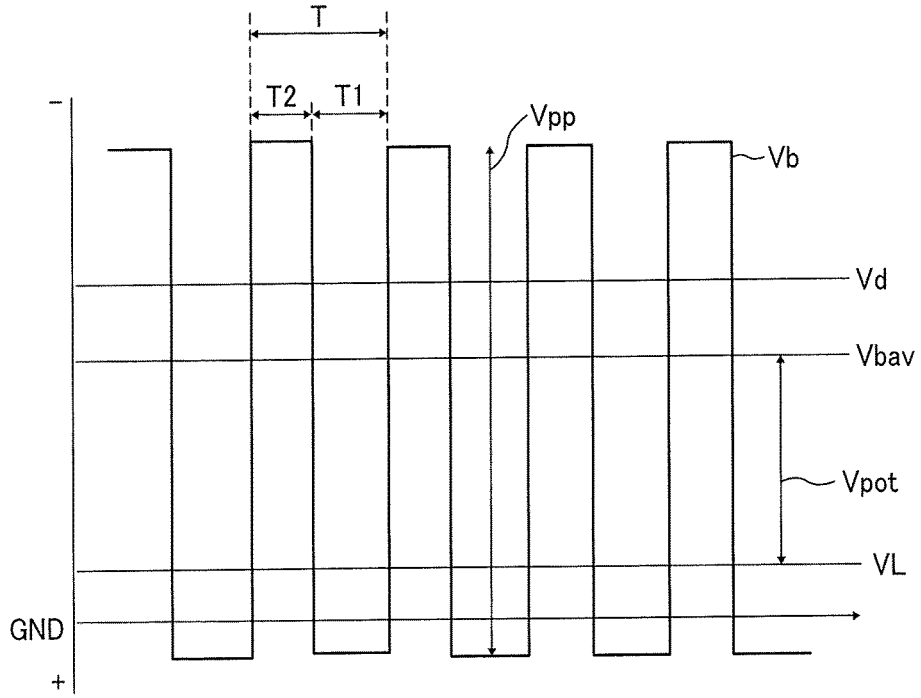
FIG. 8 is a graph of a waveform of a developing bias in AC bias development according to a comparative example.

FIG. 8 is a graph of a waveform of the developing bias Vb in typical AC bias development according to a comparative example.

The comparative waveform illustrated in FIG. 8 has a frequency of 5 to 10 kHz and an opposite-polarity duty cycle (T1/T×100) of 40 to 70%, and the peak-to-peak voltage Vpp, which is the difference between the largest value and the smallest value of the developing bias Vb, is 800 to 1500 V.

Typical AC bias development has the following merits 1) to 3), compared with DC bias development in which the developing bias is constructed of a DC component.

1) Due to an oscillating electric field, toner particles can be rearranged with high degree of conformity to the latent image to improve the granularity.

2) Compared with DC bias development, toner is peeled off from the carrier with a stronger electrical field, and the amount of toner that contributes to developing increases to improve developability.

3) The developing electrical field is equalized to alleviate unevenness in developing caused by deviations and fluctuations of the developing gap.

Recently, electrophotographic image forming apparatuses are introduced in the production printer market, and there are demands for, in addition to image quality improvement, reduction of cost per page (CPP), meaning the print cost for one page, and expansion of preventive maintenance (PM) cycle. Accordingly, expansion of operational life of photoconductors is requested.

Application of lubricant (e.g., zinc stearate) to the photoconductor is effective to meet such demands.

The inventors, however, have found through an experiment that AC bias development can make uneven application of zinc stearate to the photoconductor more obvious and causes uneven image density, compared with DC bias development. The amount of lubricant applied is similar to the above-described amount in the embodiment. That is, regarding the predetermined unit area (1 cm in the axial direction of the photoconductor), the amount of lubricant consumed is equal to or greater than 0.845 mg per unit photoconductor running distance of 1 km (the distance by which the photoconductor surface moves).

Experiment 1

Experiment 1 was executed to evaluate a streak image caused by uneven application of the lubricant (zinc stearate) to the photoconductor when the peak-to-peak value Vpp of the developing bias was changed and uneven image density caused by deviations and fluctuations of the developing gap.

Figure 9A:
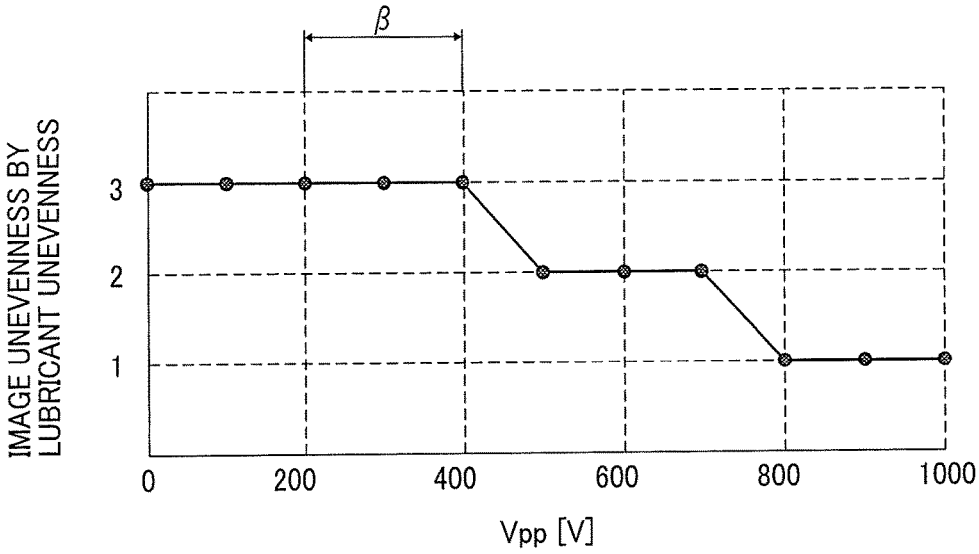
FIG. 9A is a graph schematically illustrating a relation between a peak-to-peak value and level of streaky image density unevenness, obtained from Experiment 1.
Figure 9B:
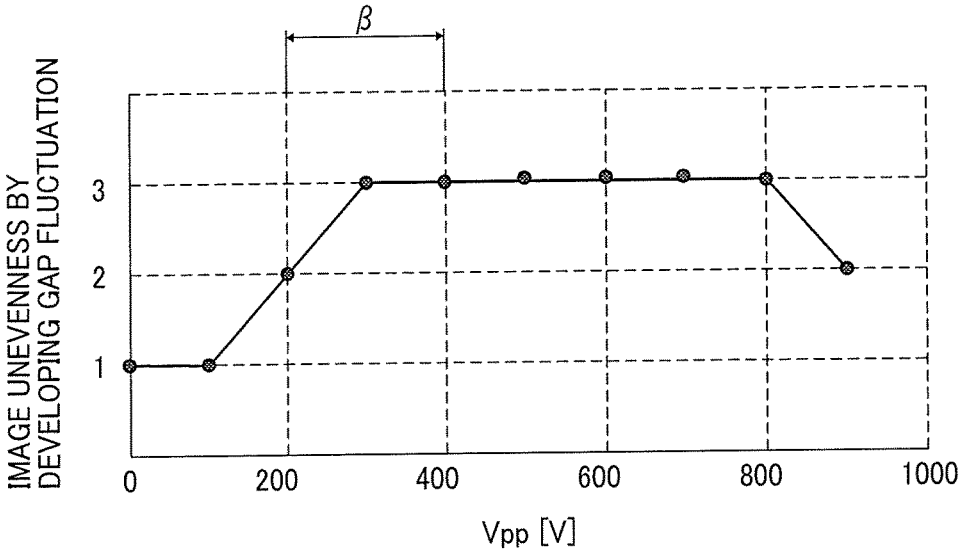
FIG. 9B is a graph illustrating a relation between the peak-to-peak value and level of uneven image density, obtained from Experiment 1.

FIGS. 9A and 9B are graph schematically illustrating results of Experiment 1.

Conditions of Experiment 1 are as follows.

Image forming apparatus used: RICOH Pro C9110;

Changes in peak-to-peak value Vpp: Increased from 0 V (DC) in increments of 100 V;

Amount of lubricant applied: 3.6 mg;

Developing bias average Vbav: −350 V;

Charged potential Vd: −450 V;

Exposure potential VL: −100 V;

Range of developing bias frequency (1/T): 5.0 kHz to 10 kHz; and

Range of opposite-side duty cycle (T1/T×100): 40% to 70%

The amount of lubricant applied under the above-mentioned conditions is the amount applied in the unit area of 1 cm in the axial direction of the photoconductor, per unit running distance of 1 km of the photoconductor.

The range of frequency (1/T) of the developing bias Vb and the range of the opposite-polarity duty cycle (T1/T×100) were set to the above ranges from the following reason.

When the frequency (1/T) of the developing bias Vb is smaller than 5 kHz, the capability of toner to follow the alternating electrical field is excessive and graininess is aggravated. By contrast, when the frequency (1/T) of the developing bias Vb is greater than 10 kHz, the capability of toner to follow the alternating electrical field is insufficient and graininess is aggravated. Since the developing bias frequency outside the above-mentioned range was undesirable from the point of graininess under any of the above conditions, the range of the frequency (1/T) of the developing bias Vb was set to the above-mentioned range.

Additionally, as the opposite-polarity duty cycle (T1/T×100) increases, color unevenness, graininess, and background fog (background stain) are aggravated, and adhesion of carrier increases. Since such defects are suppressed to allowable degrees when the opposite-polarity duty cycle is in a range of 40% to 70%.

FIG. 9A is a graph illustrating a relation between the peak-to-peak value Vpp of the AC developing bias (represented by the lateral axis) and level of streaky image density unevenness (represented by the vertical axis). The streaky image density unevenness mentioned here is caused by uneven application of lubricant (zinc stearate) onto the photoconductor 1.

On the vertical axis in FIG. 9A, the streaky image density unevenness was subjectively evaluated in three levels of Level 1: a streak is visible; Level 2: a streak is recognized in careful observation; and Level 3: no streak is visible.

As illustrated in FIG. 9A, as the peak-to-peak value Vpp of the AC developing bias increases, the streaky image density unevenness caused by uneven application of lubricant (zinc stearate) onto the photoconductor 1 tends to worsen.

The level of streaky image density unevenness caused by uneven application of lubricant (zinc stearate) onto the photoconductor 1, represented by the vertical axis, varies depending the state of photoconductor surface that wears with elapse of time and the state of edge of the leveling blade 210 (illustrated in FIG. 6). Typically, as time of use becomes longer, the edge of the leveling blade wears more, and application of lubricant becomes more uneven. In Experiment 1 illustrated in FIG. 9A, to increase the unevenness in application of lubricant, a used photoconductor and a used leveling blade were used and the application amount of lubricant was set to the largest amount of usage conditions of the image forming apparatus used in the experiment.

Additionally, as the peak-to-peak value Vpp is increased from 0 V (that is, the level of DC developing bias), streaky image density unevenness caused by uneven application of lubricant (zinc stearate) onto the photoconductor is aggravated relatively.

Considering streaky image density unevenness, the peak-to-peak value Vpp is preferably equal to or smaller than 400 V according to FIG. 9A.

Currently, it is not clear why increasing the peak-to-peak value Vpp results in aggravation of streaky unevenness and why decreasing the peak-to-peak value Vpp results in inhibition of streaky unevenness. However, the results are similar even when the amount of lubricant applied is increased and when a different image forming apparatus is used. Therefore, the peak-to-peak value Vpp is preferably equal to or smaller than 400 V because streaky image density unevenness is noticeable.

Regarding the frequency of the AC developing bias, the streaky image density unevenness caused by uneven application of lubricant (zinc stearate) onto the photoconductor rarely depends on the frequency of the AC developing bias in the evaluated range of from 5.0 kHz to 10 kHz. Regarding the opposite-polarity duty cycle of the AC developing bias, the streaky image density unevenness caused by uneven application of lubricant (zinc stearate) onto the photoconductor rarely depends thereon in the evaluated range of from 40% to 70%.

FIG. 9B illustrates a relation between the peak-to-peak value Vpp of the AC developing bias (represented by the lateral axis) and level of uneven image density caused by fluctuations of the developing gap (represented by the vertical axis).

Similar to the vertical axis in FIG. 9A, on the vertical axis in FIG. 9B, the uneven image density caused by fluctuations in the developing gap was subjectively evaluated in three levels of Level 1: uneven image density is visible, Level 2: uneven image density is recognized in careful observation, and Level 3: uneven image density is not visible.

As illustrated in FIG. 9B, compared with the peak-to-peak value Vpp being "0" (that is, the DC developing bias), the uneven image density caused by fluctuations in the developing gap is alleviated as the peak-to-peak value Vpp increases. In the case of AC developing bias, the uneven image density caused by fluctuations in the developing gap is alleviated because the AC electrical field can equalize the developing electrical field.

However, the voltage exceeds the dielectric strength of the carrier if the peak-to-peak value Vpp is too large. Then, micro discharge occurs in the developing range, and the image density becomes more uneven. The peak-to-peak value Vpp that worsens the image density unevenness differs depending on the resistance (dielectric strength) of the carrier.

In FIG. 9B, around when the peak-to-peak value Vpp exceeds 200 V, the uneven image density caused by fluctuations in the developing gap is alleviated compared with DC developing. The alleviation effect is largest in a range from 600 V to 900 V.

According to FIGS. 9A and 9B, to alleviate the uneven image density caused by fluctuations in the developing gap and suppress the streak caused by uneven application of lubricant, the peak-to-peak value Vpp is preferably equal to or greater than 200 V and equal to or smaller than 400 V (hereinafter "range of 200 V to 400 V).

Note that the uneven image density caused by fluctuations in the developing gap rarely depends on the frequency of the AC developing bias in the evaluated range of from 5.0 kHz to 10 kHz. Additionally, the uneven image density caused by fluctuations in the developing gap rarely depends on the opposite-polarity duty cycle of the AC developing bias in the evaluated range of from 40% to 70%.

Based on Experiment 1, in the image forming apparatus 100 according to the present embodiment, when the amount of the lubricant consumed per the above-described unit area is 0.845 mg or greater, the peak-to-peak value Vpp is set to the range of 200 V to 400 V (a range β in FIGS. 9A and 9B). The operational life of the photoconductor 1 can be expanded to the level requested in the production printer market when the amount of the lubricant consumed per the above-described unit area is 0.845 mg or greater. Further, setting the peak-to-peak value Vpp to the range of 200 V to 400 V is advantageous in that the streaky image density unevenness caused by uneven application of lubricant onto the photoconductor is not worse than that in DC bias developing and the uneven image density caused by fluctuations in the developing gap is alleviated better than that in DC bias developing.

Not limited to the test machine used in Experiment 1, effects similar to those attained in Experiment 1 are available in image forming apparatuses in which the amount of lubricant applied to the photoconductor is set to the above-described range and the peak-to-peak value Vpp of the AC developing bias is set to the above-described range.

Although the amount of lubricant applied is 3.6 mg in Experiment 1, as long as the amount of lubricant applied is equal to or greater than 0.845 mg, the peak-to-peak value Vpp of the AC developing bias can be set to the range of 200 V to 400 V from the following factors.

When the amount of lubricant applied is smaller than 3.6 mg, the degree of possible unevenness in application of lubricant is reduced. Accordingly, although there are cases where the streaky unevenness caused by unevenness in application of lubricant is smaller than the result of Experiment 1, the streaky unevenness does not increases therefrom. Therefore, the effect of inhibition of streaky unevenness would be attained similarly when the peak-to-peak value Vpp of the AC developing bias is equal to or smaller than 400 V. Additionally, the uneven image density caused by fluctuations of the developing gap does not relate to the amount of lubricant applied. Therefore, the effect of inhibition of uneven image density caused by fluctuations of the developing gap would be attained similarly when the peak-to-peak value Vpp of the AC developing bias is equal to or greater than 200 V. Thus, when the amount of lubricant applied is equal to or greater than 0.845 mg, the effect attained with the peak-to-peak value Vpp of the AC developing bias being in the range of 200 V to 400 V can be attained.

Similarly, even when the developing bias average Vbav, the charged potential Vd, and the exposure potential VL are different from the values in Experiment 1, in configurations employing AC bias development, the peak-to-peak value Vpp of the AC developing bias can be set to the range of 200 V to 400 V.

This is because the streaky unevenness caused by uneven application of lubricant does not depend on potential though the reason thereof is not clear. Even when the potential is different, the effect of alleviation of streaky unevenness is attained similarly under the peak-to-peak value Vpp not greater than 400 V. The amount of fluctuation of the developing gap does not change even when the potential is changed. Accordingly, setting of the peak-to-peak value Vpp set for fluctuations in the developing gap does not change but is equal to or greater than 200 V similarly.

When the peak-to-peak value Vpp is set to the range of 200 V to 400 V, the merits 1) and 2) of the above-described three merits of typical AC bias development are rarely attained because the range of peak-to-peak value Vpp is smaller than that of typical AC bias development.

As illustrated in FIG. 7, the peak-to-peak value Vpp in the image forming apparatus 100 according to the present embodiment is smaller than the peak-to-peak value Vpp used in typical AC bias development (800 V to 1500 V). With such setting, only the merit 3) of the above-described three merits of typical AC bias development is available. Additionally, the setting of amount of lubricant applied is equal to or greater than 0.845 mg per centimeter (the predetermined unit area of 1 cm) in the axial direction of the photoconductor) for a photoconductor running distance of 1 km, which is necessary to expand the operational life of the photoconductor. Additionally, inhibition of streaky image density unevenness caused by uneven application of lubricant (zinc stearate) onto the photoconductor, as a side effect of the setting of lubrication amount, and the merit 3) are balanced.

To attain effects closer to the merits 1) and 2) of the above-described three merits of typical AC bias development, the image forming apparatus 100 according to the present embodiment has the following structure.

The developing device 5 includes two developing rollers (the first and second developing rollers 71 and 75), and the first developing sleeve 72 of the first developing roller 71 passes the two component developer to the second developing sleeve 76 of the second developing roller 75.

In the developing device 5 including the two developing rollers, when the first developing sleeve 72 develops the electrostatic latent image on the photoconductor 1, the amount of toner located around the tip of a developer bristle (near the surface of the photoconductor 1) contributable to developing decreases. Simultaneously, counter charge accumulates on the carrier as the toner is peeled off from the carrier. Then, the peeling off toner from carrier becomes less easy. In the case of a developing device including one developing roller, as the toner contributable to developing is exhausted, the latent image is not developed any more, and the developability is exerted no more. When the developing ends due to the exhaustion of toner contributable to developing, adhesion of toner to the latent image is not very precise, making the image quality lower in graininess.

By contrast, the developing device 5 according to the present embodiment in which the first developing sleeve 72 passes the two component developer to the second developing sleeve 76, the two component developer behaves as follows. As the first developing sleeve 72 rotates, the developer carried thereon is used in image development in the first developing range 74 and then transported to a position facing the second developing sleeve 76. At the time of forwarding of the two component developer from the first developing sleeve 72 to the second developing sleeve 76, the developer at the tip of the developer bristle on the first developing sleeve 72 moves to the root of a developer bristle on the second developing sleeve 76. By contrast, the developer at the root of the developer bristle on the first developing sleeve 72 moves to the tip of the developer bristle on the second developing sleeve 76. Thus, the amount of toner contributable to developing recovers in the developer.

Additionally, since the developer is stirred at the time of forwarding of the developer from the first developing sleeve 72 to the second developing sleeve 76, the counter charge is alleviated. Then, the electrostatic latent image on the surface of the photoconductor 1 is developed again in the second developing range, using the developer on the second developing sleeve 76, in which the amount of toner contributable to developing has recovered. Accordingly, compared with the developing device including only one developing roller, the developing device 5 including the two developing rollers can cause the toner to adhere to the electrostatic latent image more precisely, improving graininess.

As described above, in the image forming apparatus 100 according to the present embodiment, the developing device 5 including the two developing rollers can improve the graininess. Further, the amount of toner contributable to developing is increased to enhance the developability. Accordingly, effects closer to the above-described merits 1) and 2) of typical AC bias development can be attained.

In the image forming apparatus 100 according to the present embodiment, to expand the operational life of the photoconductor 1, the amount of zinc stearate applied to the photoconductor 1 is relatively large and equal to or greater than 0.845 mg per unit area of 1 cm in the axial direction of the photoconductor 1 and unit running distance of 1 km. Although streaky image density unevenness caused by uneven application of zinc stearate onto the photoconductor 1 tends to be noticeable in application of AC developing bias, such a side effect is suppressed by setting the peak-to-peak value Vpp of the AC developing bias to the range of 200 V to 400V. Additionally, when the peak-to-peak value Vpp is set to this range, the above-described merit 3) of AC bias development over direct current (DC) bias development can be attained. That is, the developing electrical field is equalized to alleviate unevenness in developing caused by deviations and fluctuations of the developing gap. When the unevenness in developing is alleviated, uneven image density of the toner image formed on the photoconductor 1 can be alleviated to make the density of the image output on the transfer sheet P more uniform.

The image forming apparatus 100 uses the developing device 5 that includes two developing rollers and passes two component developer from the first developing sleeve 72 to the second developing sleeve 76. Accordingly, the image forming apparatus 100 can attain improvement of graininess and improvement of developability of levels close to the above-described merits 1) and 2) attained with the peak-to-peak value Vpp of 800 V to 1500 V, which is the condition of typical AC bias development.

Accordingly, the image forming apparatus 100 according to the present embodiment can attain high image quality and long life of the photoconductor 1 requested in the production printer market.

As an example structure to develop an electrostatic latent image on one photoconductor with two developing rollers, two developing devices using identical color toner may be disposed around one photoconductor. This configuration can improve graininess and developability similar to the above-described image forming apparatus 100. Use of a developing device including two developing rollers, as in the image forming apparatus 100 according to the present embodiment, is advantageous in keeping the apparatus compact, over use of two developing devices provided for one photoconductor.

Regarding the charging device 4 to uniformly charge the photoconductor 1, a charging roller to apply an AC bias to a micro gap to cause discharge for the charging the photoconductor 1 can pose a large hazard on the photoconductor 1. Such a charging roller is not preferred to expand the operational life of the photoconductor 1. To expand the operational life of the photoconductor 1, as the charging device 4, a scorotron charger that poses a smaller hazard on the photoconductor 1 is preferred.

Modification

Next, a modification of the image forming apparatus 100 is described below.

In the above-described image forming apparatus 100, the four image forming units 6 (Y, M, C, and K) are similar in structure except that the color of the toner (image forming material) used therein is different from each other. In the modification, of the four image forming units 6, the three image forming units 6Y, 6M, and 6C using color toners (yellow, magenta, and cyan toners) use the AC developing bias similar to the embodiment described above. By contrast, the image forming unit 6K using black toner uses the DC developing bias, differently from the above-described image forming apparatus 100. The image forming unit 6K serves as a black image forming device, and the image forming units 6Y, 6M, and 6C serve a color image forming device to use color toner other than the black toner.

Experiment 2

Experiment 2 was executed to evaluate a streak image caused by uneven application of the lubricant (zinc stearate) to the photoconductor when the peak-to-peak value Vpp of the developing bias was changed. The evaluation result obtained when black toner was used was compared with the evaluation result obtained when color toner was used.

Figure 10:
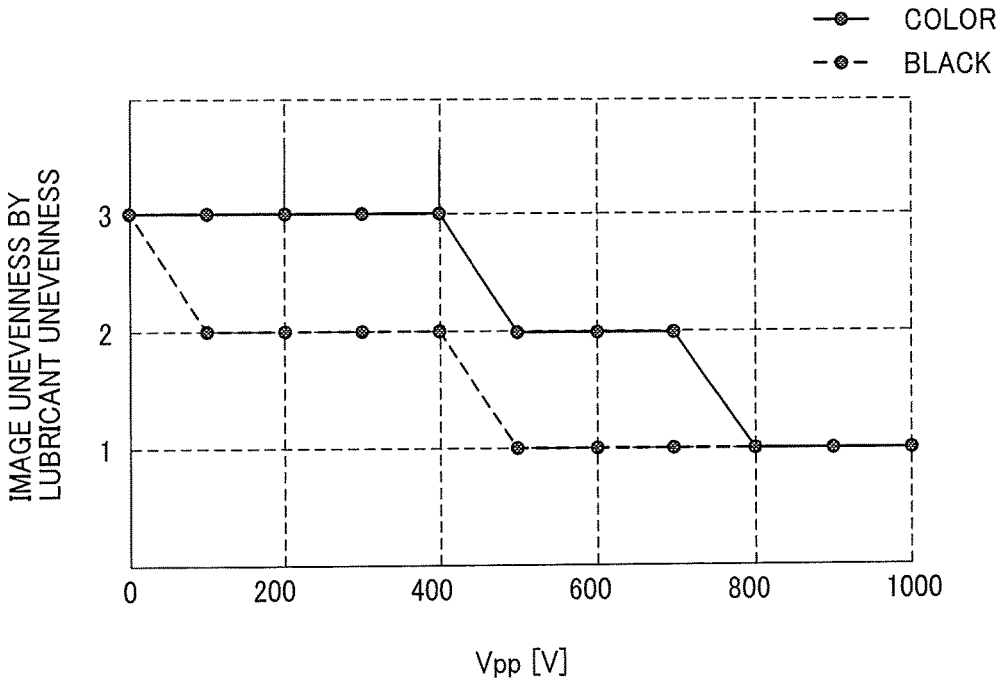
FIG. 10 is a graph schematically illustrating a result of Experiment 2.

FIG. 10 is a graph schematically illustrating results of Experiment 2.

Experiment 2 was executed under conditions similar to those of Experiment 1 described above.

FIG. 10 is a graph illustrating a relation between the peak-to-peak value Vpp of the AC developing bias (represented by the lateral axis) and level of streaky image density unevenness caused by uneven application of zinc stearate as lubricant onto the photoconductor (represented by the vertical axis). In FIG. 10, the relation is different between the case where black toner was used and the case where color toner was used.

In FIG. 10, the solid line represents the result in the case where color toner was used, and broken lines represent the results in the case where black toner was used.

On the vertical axis in FIG. 10, the streaky image density unevenness caused by uneven application of lubricant was subjectively evaluated in three levels of Level 1: a streak is visible, Level 2: a streak is recognized in careful observation, and Level 3: no streak is visible.

The relation of toner adhesion amount and density (lightness) changes more steeply in the case of black toner than the case of color toner. Accordingly, the streaky image density unevenness (difference in toner adhesion amount between the streak and a portion without the streak) caused by uneven application is more distinctive in black toner than color toner as illustrated in FIG. 10.

Experiment 3

Experiment 3 was executed to evaluate uneven image density caused by fluctuations the developing gap in relation to the runout amount of the developing sleeve.

Figure 11:
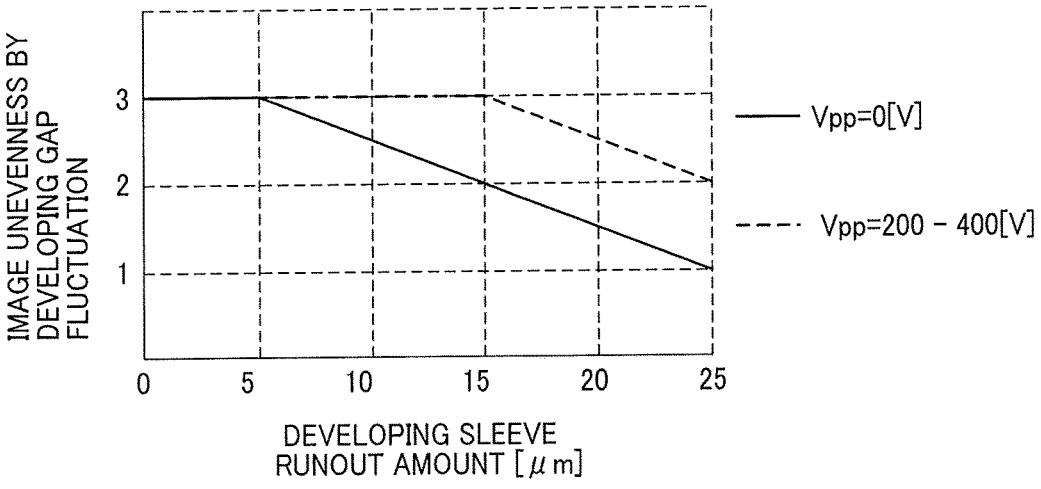
FIG. 11 is a graph schematically illustrating a result of Experiment 3.

FIG. 11 is a graph illustrating results of Experiment 3.

Experiment 3 was executed under conditions similar to those of Experiment 1 described above.

FIG. 11 illustrates a relation between the runout amount of the developing sleeve (represented by the lateral axis) and level of uneven image density caused by fluctuations of the developing gap (represented by the vertical axis). In FIG. 11, the result obtained when the peak-to-peak value Vpp of the AC developing bias is 0 V (DC developing), represented by the solid line, is compared with the result obtained when the peak-to-peak value Vpp ranges from 200 V to 400 V, represented by the broken lines.

The level of uneven image density caused by fluctuations in the developing gap, represented by the vertical axis in FIG. 11, was evaluated subjectively in three levels of Level 1: uneven image density is visible, Level 2: uneven image density is recognized in careful observation, and Level 3: uneven image density is not visible.

As illustrated in FIG. 11, under the condition of the peak-to-peak value Vpp of the AC developing bias ranging from 200 V to 400 V, even when the runout amount of the developing sleeve is relatively large, the uneven image density caused by fluctuations in the developing gap is inhibited owing to the effect of the AC developing bias. By contrast, under the condition of peak-to-peak value Vpp being 0 V, as the runout of the developing sleeve increases, the density unevenness worsens.

According to the results in FIGS. 10 and 11, to suppress the streaky image density unevenness caused by uneven application of lubricant, in particular in the image forming unit 6K for black, setting the peak-to-peak value Vpp to 0 V is most preferable. To suppress the uneven image density caused by fluctuations in the developing gap in the image forming unit 6K for black, use of a developing sleeve whose runout amount is small is preferred.

The runout of the developing sleeve, however, occurs in manufacturing, and variations are inevitable. Therefore, the cost is high and volume production becomes difficult if developing sleeves having small runout amount are manufactured for the four colors so that the level of uneven image density would be suppressed to the level in AC bias development even when DC bias development is employed.

In view of the foregoing, in the three image forming units 6Y, 6C, and 6M using the color toners with which uneven application of lubricant is less noticeable, the AC developing bias having the peak-to-peak value Vpp of 200 V to 400 V is used as the developing bias. Accordingly, in the three image forming units 6Y, 6C, and 6M, uneven image density does not worsen even if the runout amount of the developing sleeve is large to the degree not usable in the developing device 5*k* for black.

With such structures, the image forming apparatus 100 according to the modification can attain color images of high image quality requested in the production printer market while maintaining mass production.

Although the electrophotographic image forming apparatuses according to one embodiment and the modification are described above, structures of image forming apparatuses to which aspects of this disclosure are applicable are not limited to the structures illustrated in, FIG. 1 and the like but modifications are possible.

An electrophotographic image forming apparatus includes a latent image bearer, a charger, a latent image forming device, a developing device, and a transfer device. The charger charges a surface of the latent image bearer uniformly, and the latent image forming device irradiates the surface of the latent image bearer with light to form an electrostatic latent image thereon. Then, the developing device supplies the electrostatic latent image with toner included in the developer, forming a toner image. The transfer device transfers the toner image from the latent image bearer, either via an intermediate transferor or directly, onto a recording medium.

Additionally, in the electrophotographic image forming apparatus to which aspects of this disclosure are applicable, the developing device includes a developer bearer configured to bear the developer and disposed opposite the latent image bearer, and a developing voltage including an AC component is applied to the developer bearer. The image forming apparatus further includes a lubricant applicator to apply lubricant onto the surface of the latent image bearer.

The structures described above are just examples, and the various aspects of the present specification attain respective effects as follows.

Aspect A

An electrophotographic image forming apparatus such as the image forming apparatus 100 includes a latent image bearer, such as the photoconductor 1, a lubricant applicator, such as the application brush 211, to apply lubricant such as zinc stearate onto a surface of the latent image bearer, and a developing device that uses a developing voltage (developing bias) including an AC component. An amount of lubricant applied by the lubricant applicator onto the latent image bearer per centimeter in the axial direction of the latent image bearer (perpendicular to the direction of movement of the surface thereof) is equal to or greater than 0.845 mg per kilometer as a unit running distance of the latent image bearer. The difference (e.g., peak-to-peak voltage Vpp) between the largest value and the smallest value of the developing voltage is in a range of 200 V to 400 V.

As ascertained by the experiments performed by the inventors, this aspect can expand the operational life of the latent image bearer in AC development and suppress streaky image density unevenness while ameliorating uneven image density caused by fluctuations of the developing gap better than DC development from the following factors.

As ascertained by the experiments performed by the inventors, in AC development, the uneven image density caused by fluctuations in the developing gap tends to decrease as the difference between the largest value and the smallest value of the developing voltage increases. By contrast, in AC development, the streaky image density unevenness due to uneven application of lubricant can arise with elapse of time. The streaky image density unevenness tends to worsen as the difference between the largest value and the smallest value of the developing voltage increases. Therefore, the amount of lubricant applied and the difference between the largest value and the smallest value of the developing voltage are set to the ranges according to Aspect to suppress streaky image density unevenness while ameliorating uneven image density caused by fluctuations of the developing gap better than DC development.

Aspect B

In Aspect A, the developing device (e.g., the developing device 5) includes, as developer bearers, a first developer bearer (e.g., the first developing sleeve 72) to bear, on a surface thereof, developer including toner supplied from a developer containing compartment (e.g., the developer supply chamber 52) and convey the developer to a first developing range (e.g., the first developing range 74) disposed opposite the latent image bearer (e.g., the photoconductor 1), and a second developer bearer (e.g., the second developing sleeve 76) to receive the developer from the surface of the first developer bearer that has passed through the first developing range. The second developer bearer conveys the developer to a second developing range (e.g., the second developing range 78) disposed opposite the latent image bearer (e.g., the photoconductor 1) and sends the developer that has passed through the second developing range to another developer containing compartment (e.g., the developer collecting chamber 53).

With this configuration, as described above, the graininess of the developed toner image improves, and the developability improves.

Aspect C

In Aspect A or B, the charger such as the charging device 4 is a scorotron charger.

As described above, this aspect can reduce the hazard on the latent image bearer (e.g., the photoconductor 1) to expand the operational life of the latent image bearer.

Aspect D

In any one of Aspects A through C, the image forming apparatus includes a plurality of toner image forming devices (the image forming units 6) each of which including the latent image bearer (e.g., the photoconductor 1) and the developing device (e.g., the developing device 5). The plurality of toner image forming devices includes a black image forming device (e.g., the image forming unit 6K) to use black toner, and three color image forming devices (e.g., the image forming units 6Y, 6C, and 6M) to use color toners other than black toner. The black image forming device uses a developing voltage (developing bias) without an AC component.

With this configuration, as described above, in the black image forming device, worsening of streaky image density unevenness caused by uneven application of lubricant is inhibited.

Aspect E

In Aspect D, the developer bearer (e.g., the first and second developing sleeves 72 and 76) is a rotatable developing sleeve inside which a magnetic field generator (e.g., the magnet rollers 73 and 77) is disposed. The developing sleeve of the developing device of the black image forming device is smaller in runout amount (higher in runout accuracy) than the developing sleeves of the developing devices of the three color image forming devices (e.g., the image forming units 6Y, 6C, and 6M).

As described above, with this aspect, high-quality color images are produced while maintaining mass production.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. An electrophotographic image forming apparatus comprising:

a latent image bearer to rotate and bear a latent image;

a charging device to charge the a latent image bearer;

a developing device to develop the latent image with developer including toner and use a developing voltage including an AC component; and a lubricant applicator to apply lubricant onto a surface of the latent image bearer, wherein an amount of the lubricant applied by the lubricant applicator onto the latent image bearer per centimeter in an axial direction of the latent image bearer is equal to or greater than 0.845 mg for a running distance of 1.0 kilometer of the latent image bearer, wherein a difference between a largest value and a smallest value of the developing voltage is in a range of 200 V to 400 V, an average value of the developing voltage being less than 0 V, and the largest value of the developing voltage being closer to 0 V than the smallest value of the developing voltage.

2. The image forming apparatus according to claim 1, wherein the developing device includes:

a developer containing compartment to contain the developer;

a first developer bearer to bear the developer supplied from the developer containing compartment and convey the developer to a first developing range disposed opposite the latent image bearer; and a second developer bearer to receive the developer from the first developer bearer at a position downstream from the first developing range in a direction of rotation of the first developer bearer, the second developer bearer to convey the developer to a second developing range disposed opposite the latent image bearer and send the developer to the developer containing compartment at a position downstream from the second developing range in a direction of rotation of the second developer bearer.

3. The image forming apparatus according to claim 2, wherein the first developer bearer includes a first developing sleeve, and a first magnet roller that is unitary and disposed inside the first developing sleeve, wherein the second developer bearer includes a second developing sleeve, and a second magnet roller that is unitary and disposed inside the second developing sleeve, and wherein the second developer bearer is disposed below the first developer bearer inside the developing device.

4. The image forming apparatus according to claim 3, wherein each of the first and second magnet rollers includes five magnetic poles: two north poles and three south poles.

5. The image forming apparatus according to claim 1, wherein the charging device includes a scorotron charger.

6. An image forming apparatus comprising:

a plurality of toner image forming devices each of which including:

a latent image bearer to bear a latent image;

a developing device to develop the latent image with developer including toner; and a lubricant applicator to apply lubricant onto a surface of the latent image bearer, the plurality of toner image forming devices including:

a black image forming device to use black toner and a developing bias without an AC component; and a color image forming device to use color toner other than the black toner and a developing voltage including an AC component, wherein an amount of the lubricant applied by the lubricant applicator onto the latent image bearer per centimeter in an axial direction of the latent image bearer is equal to or greater than 0.845 mg for a running distance of 1.0 kilometer of the latent image bearer, and wherein a difference between a largest value and a smallest value of the developing voltage including the AC component is in a range of 200 V to 400 V, an average value of the developing voltage being less than 0 V, and the largest value of the developing voltage being closer to 0 V than the smallest value of the developing voltage.

7. The image forming apparatus according to claim 6, wherein the developing device of each of the plurality of toner image forming devices includes:

a developing sleeve to rotate and bear the developer; and a magnetic field generator disposed inside the developing sleeve, wherein the developing sleeve of the developing device of the black image forming device is smaller in runout amount than the developing sleeve of the developing device of the color image forming device.

* * * * *